US005522528A

United States Patent [19]

Petricola

[11] Patent Number: 5,522,528

[45] Date of Patent: Jun. 4, 1996

[54] BABY CARRIER APPARATUS

[76] Inventor: John L. Petricola, 1821 Vincennes Pl., Wilmington, N.C. 28405

[21] Appl. No.: 499,869

[22] Filed: Jul. 10, 1995

[51] Int. Cl.[6] ..... A61G 1/00

[52] U.S. Cl. ..... 224/160; 224/161; 224/257; 224/259; 224/262; 224/638; 224/646; 224/578; D3/214; D3/216

[58] Field of Search ..... 224/151, 155, 224/158, 159, 160, 161, 209, 215, 224, 257, 258, 259, 262; 297/464, 465, 467, 468; D3/213, 214, 215, 216, 217

[56] References Cited

U.S. PATENT DOCUMENTS

| | | | |
|---|---|---|---|
| 4,469,259 | 9/1984 | Krich et al. | 224/160 |
| 4,579,264 | 4/1986 | Napolitano | 224/160 |
| 4,724,988 | 2/1988 | Tucker | 224/160 |
| 5,011,057 | 4/1991 | Perruzza et al. | 224/158 |
| 5,071,047 | 12/1991 | Cordisco | 224/158 |
| 5,205,450 | 4/1993 | DeRosier | 224/161 |
| 5,205,451 | 4/1993 | Manzer | 224/161 |
| 5,246,152 | 9/1993 | Dotseth | 224/159 |
| 5,361,952 | 11/1994 | Gold | 224/159 |

*Primary Examiner*—Henry J. Recla
*Assistant Examiner*—Timothy L. Maust

[57] ABSTRACT

A baby carrier apparatus includes a shoulder harness assembly which includes a first shoulder strap and a second shoulder strap, each of which has a front portion and a back portion. The front and back portions of the first and second shoulder straps are attached to a circumferential binder. Rings are attached to the first and second shoulder straps. A seat assembly has a baby-bottom-receiving portion and a baby-back-receiving portion. The baby-bottom-receiving portion includes front restraint-strap receiving loops, and the baby-back-receiving portion includes back restraint-strap receiving loops. A weight-support strap assembly is attached to a bottom portion of the baby-bottom-receiving portion of the seat assembly. The weight-support strap assembly includes an adjustable length portion. The weight-support strap assembly includes end connectors for selectively connecting to tings either attached to the first shoulder strap or attached to the second shoulder strap. A restraint strap assembly is selectively threaded through either the front restraint-strap receiving loops or the back restraint-strap receiving loops. The restraint strap assembly includes end connectors for selectively connecting to tings attached to the first and second shoulder straps. The seat assembly includes safety strap assemblies selectively connected between the baby-bottom-receiving portion and the baby-back-receiving portion of the seat assembly.

6 Claims, 3 Drawing Sheets

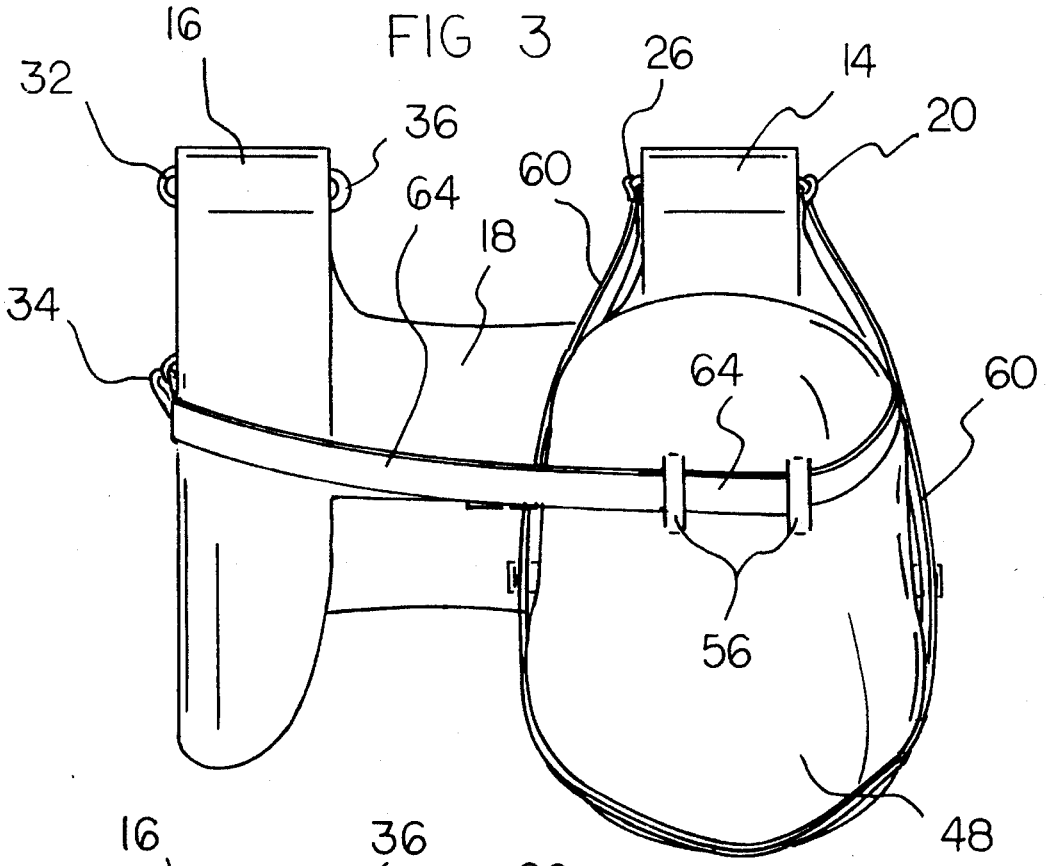
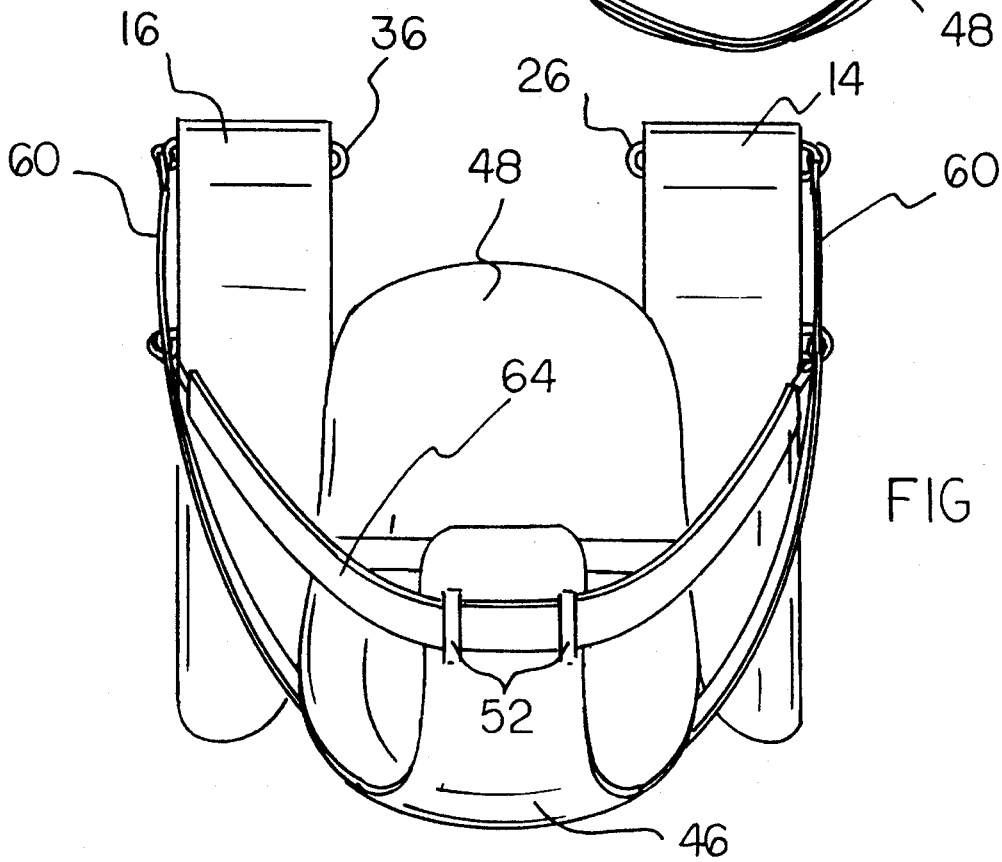
FIG 4

BABY CARRIER APPARATUS

BACKGROUND OF THE INVENTION

1. Field of the Invention

The present invention relates generally to devices designed for carrying babies and, more particularly, to devices especially adapted for carrying babies next to an adult.

2. Description of the Prior Art

The most common way for an adult to carry a baby is for the adult to hold the baby in one's arms. Yet, with the baby held in the adult's arms, the adult does not have free use of one's arms and hands. For this reason, devices have been developed for an adult to carry a baby wherein the adult's hands and arms are not used in carrying the baby. Generally, such hands-free baby carrying devices are designed to carry the baby on the adults back, with the baby facing the adult. Such an orientation of baby to adult, wherein the back of the adult faces the baby, may seem unnatural or too impersonal between baby and adult. It would seem more natural and more personal for a hands-free baby carrying device to carry the baby wherein the baby is in front of the adult.

A natural and comfortable position for a baby being carried by an adult is for the baby to carried over and adult's shoulder. In this way, the front of the baby and the front of the adult face each other. In this respect, it would be desirable if a baby carrier were provided which permitted a hands-free carrying of a baby with the front of the baby and the front of the adult facing each other. Moreover, it would be desirable if a baby carrier permitted a hands-free carrying of a baby with the front of the baby and the front of the adult facing each other in the vicinity of an adult's shoulder.

It is well known among adults who often carry babies on one's shoulder, that a person's shoulder can readily tire in carrying the baby. Generally, the adult will shift the baby from one shoulder to another shoulder in order to more evenly distribute the effort between one's shoulders. In this respect, it would be desirable if a baby carrier were provided with a mechanism that easily permitted an adult to shift most of the baby's weight from one shoulder to another shoulder when the first shoulder became tired.

Although carrying a baby facing one shoulder or another is desirable in many instances, there are other instances when the baby or the adult would prefer for the baby to be placed directly in front of the adult. Moreover, there are other instances in which it would be desirable for the baby to face forward when being carried on the front of the adult. In this respect, it would be desirable if a baby carrier were easily adjusted to vary the position and orientation of the baby to include being directly in front of the adult and with the baby facing forward with the baby's back facing the adult.

Throughout the years, a number of innovations have been developed relating to baby carriers, and the following U.S. patents are representative of some of those innovations: U.S. Pat. Nos. 4,469,259; 4,579,264; 5,011,057; 5,071,047; and 5,246,152.

Although a variety of features are disclosed in the above-listed patents, the above-listed prior art does not teach or suggest a baby carrier apparatus which has the following combination of desirable features: (1) provides hands-free carrying of a baby with the baby in front of the adult; (2) provides hands-free carrying of a baby with the front of the baby and the front of the adult facing each other; (3) provides hands-free carrying of a baby with the front of the baby and the front of the adult facing each other in the vicinity of an adult's shoulder; (4) permits an adult to easily shift most of the baby's weight from one shoulder to another shoulder when the first shoulder becomes tired; and (5) is easily adjusted to vary the position and orientation of the baby to include the baby's being directly in front of the adult and with the baby facing forward with the baby's back facing the adult. The foregoing desired characteristics are provided by the unique baby carrier apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a baby carrier apparatus which includes a shoulder harness assembly which includes a first shoulder strap which has a front portion and a back portion. A second shoulder strap also has a front portion and a back portion. The front portion and the back portion of the first shoulder strap and the front portion and the back portion of the second shoulder strap are attached to a circumferential binder. A first top outer fastener and a first bottom outer fastener are attached to the first shoulder strap. A first inner fastener is attached to the first shoulder strap. A second top outer fastener and a second bottom outer fastener are attached to the second shoulder strap. A second inner fastener is attached to the second shoulder strap.

A seat assembly has a baby-bottom-receiving portion and a baby-back-receiving portion. The baby-bottom-receiving portion includes front restraint-strap receiving loops, and the baby-back-receiving portion includes back restraint-strap receiving loops. A weight-support strap assembly is attached to a bottom portion of the baby-bottom-receiving portion of the seat assembly. The weight-support strap assembly includes an adjustable length portion. The weight-support strap assembly includes a first end connector for selectively connecting to one of the fasteners either attached to the first shoulder strap or attached to the second shoulder strap. The weight-support strap assembly includes a second end connector for selectively connecting to one of the fasteners either attached to the second shoulder strap or attached to the first shoulder strap. A restraint strap assembly is selectively threaded through either the front restraint-strap receiving loops or the back restraint-strap receiving loops.

The restraint strap assembly includes a first end connector for selectively connecting to one of the fasteners attached to the first shoulder strap, and the restraint strap assembly includes a second end connector for selectively connecting to one of the fasteners attached to the second shoulder strap.

The seat assembly includes safety strap assemblies selectively connected between the baby-bottom-receiving portion and the baby-back-receiving portion of the seat assembly. A buckle and strap assembly is connected between a first front portion of the circumferential binder and a second front portion of the circumferential binder. The restraint strap assembly includes an adjustable length portion.

The first shoulder strap is in a form of a first shoulder panel, and the first top outer fastener and the first bottom outer fastener are attached to an outer edge of the first shoulder panel. The first inner fastener is attached to an inner edge of the first shoulder panel. The second shoulder strap is in a form of a second shoulder panel, and the second top outer fastener and the second bottom outer fastener are attached to an outer edge of the second shoulder panel. The second inner fastener is attached to an inner edge of the second shoulder panel.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved baby carrier apparatus which has all of the advantages of the prior art and none of the disadvantages.

It is another object of the present invention to provide a new and improved baby carrier apparatus which may be easily and efficiently manufactured and marketed.

It is a further object of the present invention to provide a new and improved baby carrier apparatus which is of durable and reliable construction.

An even further object of the present invention is to provide a new and improved baby carrier apparatus which is susceptible of a low cost of manufacture with regard to both materials and labor, and which accordingly is then susceptable of low prices of sale to the consuming public, thereby making such baby carrier apparatus available to the buying public.

Still yet a further object of the present invention is to provide a new and improved baby carrier apparatus which provides hands-free carrying of a baby with the baby in front of the adult.

Still another object of the present invention is to provide a new and improved baby carrier apparatus that provides hands-free carrying of a baby with the front of the baby and the front of the adult facing each other.

Yet another object of the present invention is to provide a new and improved baby carrier apparatus which provides hands-free carrying of a baby with the front of the baby and the front of the adult facing each other in the vicinity of the adult's shoulder.

Even another object of the present invention is to provide a new and improved baby carrier apparatus that permits an adult to easily shift most of the baby's weight from one shoulder to another shoulder when the first shoulder becomes tired.

Still a further object of the present invention is to provide a new and improved baby carrier apparatus which is easily adjusted to vary the position and orientation of the baby to include the baby's being directly in front of the adult and with the baby facing forward with the baby's back facing the adult.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a front view showing the embodiment of the baby carrier apparatus of the invention shown in FIG. 2 adjusted for carrying a baby with the front of the baby facing the left shoulder of the adult.

FIG. 4 is a front view showing the embodiment of the baby carrier apparatus of the invention shown in FIG. 3 adjusted for carrying a baby with the front of the baby facing away from the chest of the adult.

DESCRIPTION OF THE PREFERRED EMBODIMENT

Figure 1:
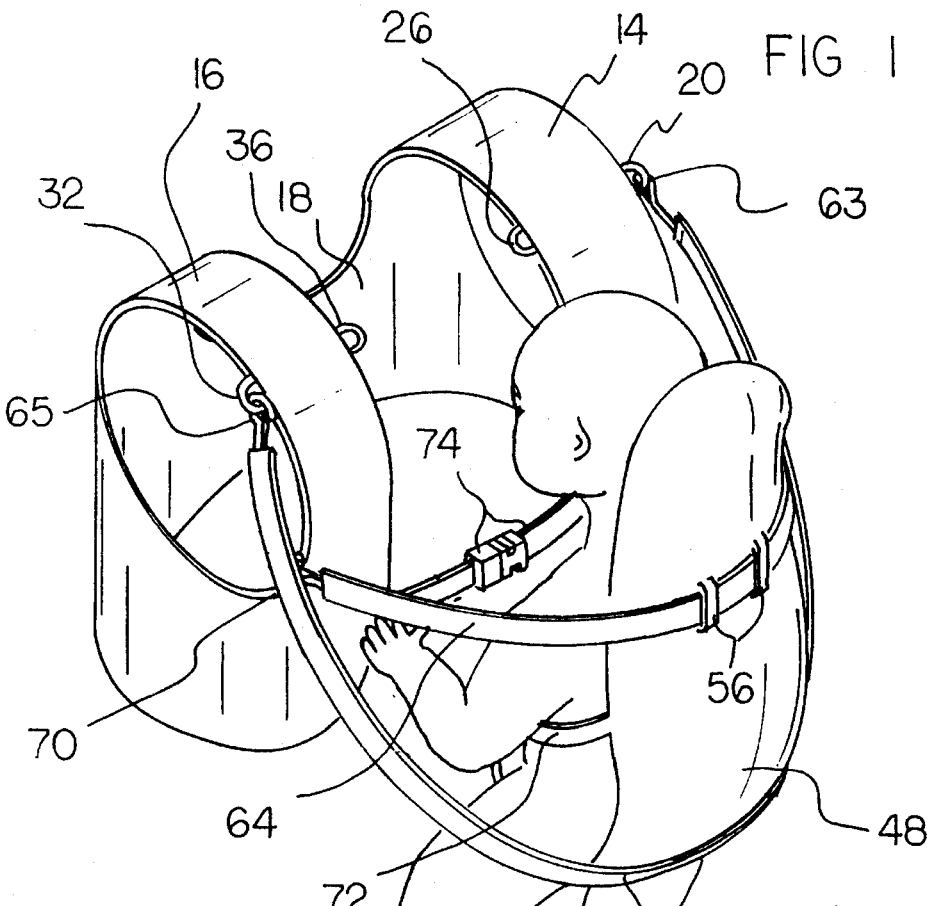
FIG. 1 is a perspective view showing a preferred embodiment of the baby carrier apparatus of the invention in use carrying a baby with the front of the baby facing the chest of the adult.

With reference to the drawings, a new and improved baby carrier apparatus embodying the principles and concepts of the present invention will be described.

Turning to FIGS. 1–5, there is shown an exemplary embodiment of the baby carrier apparatus of the invention generally designated by reference numeral 10. In its preferred form, baby carder apparatus 10 includes a shoulder harness assembly 12 which includes a first shoulder strap 14 which has a front portion and a back portion. A second shoulder strap 16 also has a front portion and a back portion. The front portion and the back portion of the first shoulder strap 14 and the front portion and the back portion of the second shoulder strap 16 are attached to a circumferential binder 18. A first top outer fastener 20 and a first bottom outer fastener 22 are attached to the first shoulder strap 14. A first inner fastener 26 is attached to the first shoulder strap 14. A second top outer fastener 32 and a second bottom outer fastener 34 are attached to the second shoulder strap 16. A second inner fastener 36 is attached to the second shoulder strap 16.

A seat assembly 44 has a baby-bottom-receiving portion 46 and a baby-back-receiving portion 48. The baby-bottom-receiving portion 46 includes front restraint-strap receiving loops 52, and the baby-back-receiving portion 48 includes back restraint-strap receiving loops 56. A weight-support strap assembly 60 is attached to a bottom portion of the baby-bottom-receiving portion 46 of the seat assembly 44. The weight-support strap assembly 60 includes an adjustable length portion 62. The weight-support strap assembly 60 includes a first end connector 63 for selectively connecting to one of the fasteners either attached to the first shoulder strap 14 or attached to the second shoulder strap 16. The weight-support strap assembly 60 includes a second end connector 65 for selectively connecting to one of the fasteners either attached to the second shoulder strap 16 or attached to the first shoulder strap 14. A restraint strap assembly 64 is selectively threaded through either the front restraint-strap receiving loops 52 or the back restraint-strap receiving loops 56. The baby-back-receiving portion 48 can have stiff material to provide a firm support for a baby's head and neck.

The restraint strap assembly 64 includes a first end connector 68 for selectively connecting to one of the fasteners attached to the first shoulder strap 14, and the restraint strap assembly 64 includes a second end connector 70 for selectively connecting to one of the fasteners attached to the second shoulder strap 16.

The seat assembly 44 includes safety strap assemblies 72 selectively connected between the baby-bottom-receiving portion 46 and the baby-back-receiving portion 48 of the seat assembly 44. A buckle and strap assembly 74 is connected between a first front portion of the circumferential binder 18 and a second front portion of the circumferential binder 18. The restraint strap assembly 64 includes an adjustable length portion 66.

The first shoulder strap 14 is in a form of a first shoulder panel, and the first top outer fastener 20 and the first bottom outer fastener 22 are attached to an outer edge 30 of the first shoulder panel. The first inner fastener 26 is attached to an inner edge 38 of the first shoulder panel. The second shoulder strap 16 is in a form of a second shoulder panel, and the second top outer fastener 32 and the second bottom outer fastener 34 are attached to an outer edge 40 of the second shoulder panel. The second inner fastener 36 is attached to an inner edge 42 of the second shoulder panel.

Figure 2:
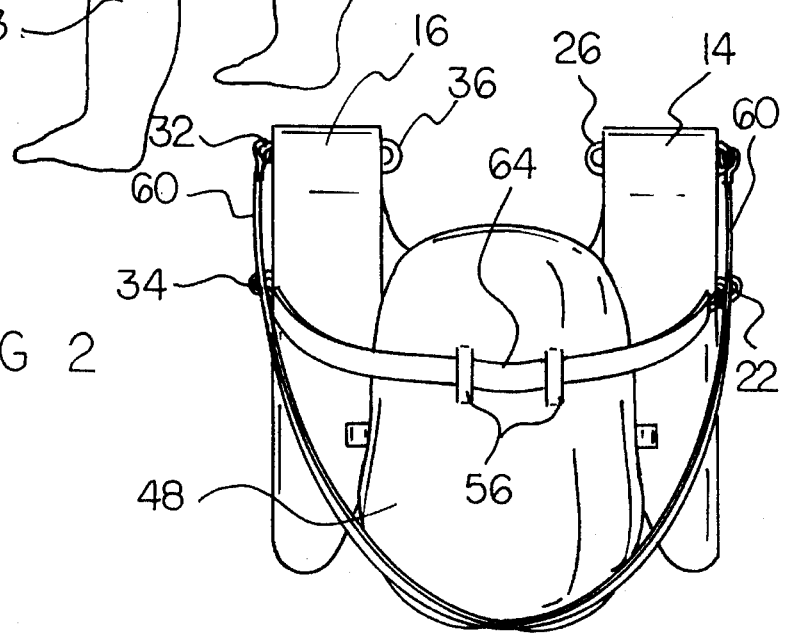
FIG. 2 is a front view of the embodiment of the baby carrier apparatus shown in FIG. 1 with the baby removed from the carrier.
Figure 5:
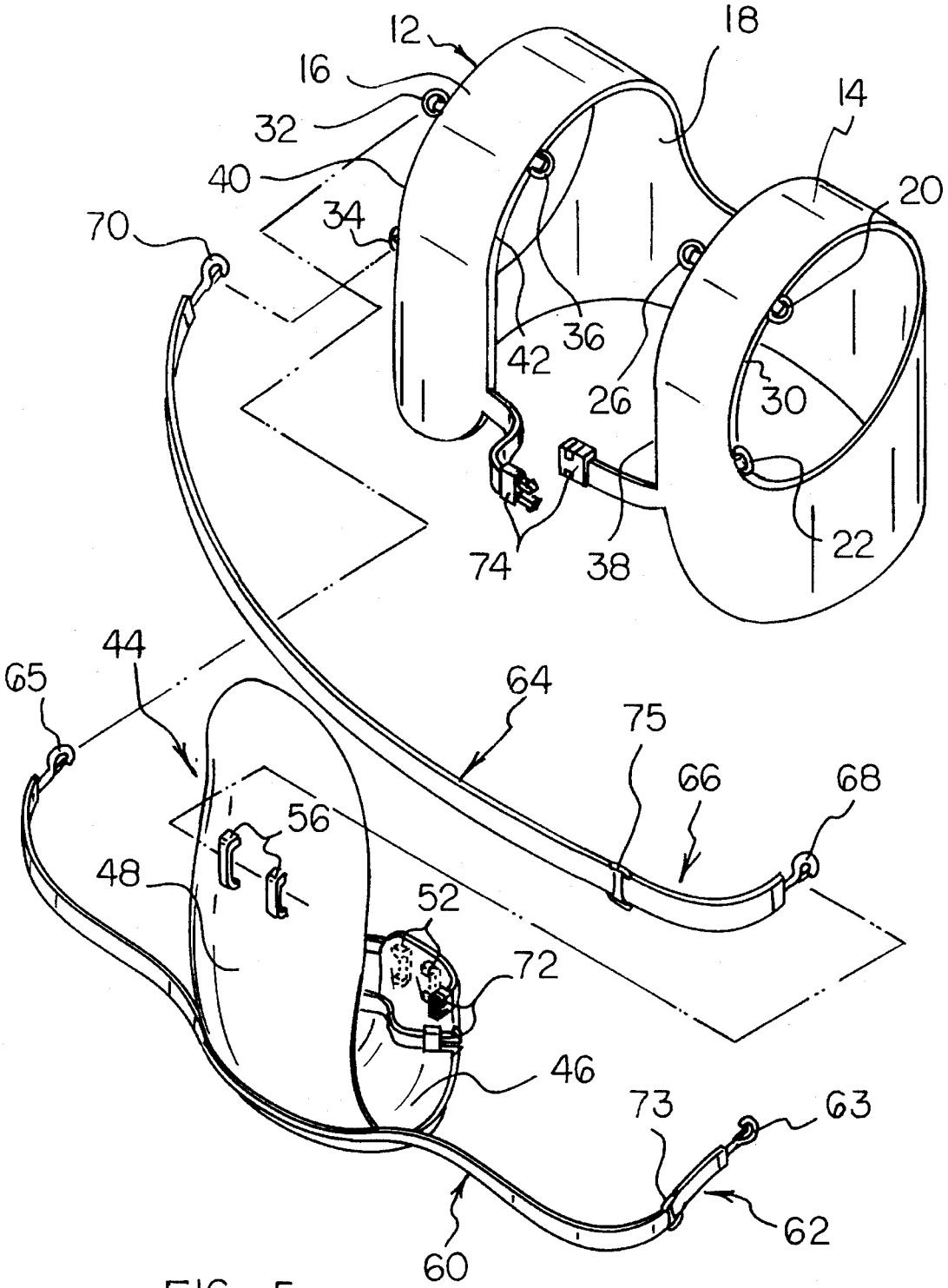
FIG. 5 is an exploded view of the embodiment of the invention shown in either FIG. 2 or FIG. 3.

FIGS. 1 and 2 show the use of the baby carrier apparatus 10 of the invention, in a mode wherein the front of a baby 13 is facing toward a chest of an adult (not shown). In this chest-facing mode, the first end connector 63 of the weight-support strap assembly 60 is connected to the first top outer fastener 20 of the first shoulder strap 14, and the second end connector 65 of the weight-support strap assembly 60 is connected to the second top outer fastener 32 of the second shoulder strap 16. In addition, in this chest-facing mode, the first end connector 68 of the restraint strap assembly 64 is connected to the first bottom outer fastener 22 of the first shoulder strap 14, and the second end connector 70 of the restraint strap assembly 64 is connected to the second bottom outer fastener 34 of the second shoulder strap 16. Moreover, the baby-back-receiving portion 48 of the seat assembly 44 is distal to the chest of the adult. In addition, the buckle and strap assembly 74 are secured together and the safety strap assemblies 72 are secured together. In this mode, the adjustable length portion 62 of the weight-support strap assembly 60 and the adjustable length portion 66 of the restraint strap assembly 64 are adjusted so that the seat assembly 44 is located midway between the ends of the respective strap assemblies.

Another mode of use of the baby carrier apparatus 10 of the invention is shown in FIG. 3. In this mode, the seat assembly 44 is positioned to face the left shoulder of an adult. More specifically, the seat assembly 44 is oriented so that the baby-back-receiving portion 48 of the seat assembly 44 is distal to and directly in front of the first shoulder strap 14. The first end connector 63 of the weight-support strap assembly 60 is connected to the first top outer fastener 20 of the first shoulder strap 14. The second end connector 65 of the weight-support strap assembly 60 is connected to the first inner fastener 26 of the first shoulder strap 14. The first end connector 68 of the restraint strap assembly 64 is connected to the first bottom outer fastener 22 of the first shoulder strap 14, and the second end connector 70 of the restraint strap assembly 64 is connected to the second bottom outer fastener 34 of the second shoulder strap 16. The adjustable length portion 62 of the weight-support strap assembly 60 and the adjustable length portion 66 of the restraint strap assembly 64 are adjusted so that this left-shoulder-facing mode is obtained. In addition, the buckle and strap assembly 74 are connected together, and the safety strap assemblies 72 are connected together.

Still another mode of using the baby carrier apparatus 10 of the invention is shown in FIG. 4. In this mode, the back of the baby 13 is proximal to the chest of the adult, and the front of the baby 13 is distal to the chest of the adult. That is, the baby-back-receiving portion 48 of the seat assembly 44 rests upon the chest of the adult, and the baby 13 faces away from the adult. In this facing-away-from-the-chest mode, the first end connector 63 of the weight-support strap assembly 60 is connected to the first top outer fastener 20 of the first shoulder strap 14, and the second end connector 65 of the weight-support strap assembly 60 is connected to the second top outer fastener 32 of the second shoulder strap 16. In addition, in this facing-away-from-the-chest mode, the first end connector 68 of the restraint strap assembly 64 is connected to the first bottom outer fastener 22 of the first shoulder strap 14, and the second end connector 70 of the restraint strap assembly 64 is connected to the second bottom outer fastener 34 of the second shoulder strap 16. In addition, the buckle and strap, assembly 74 are secured together and the safety strap assemblies 72 are secured together. In this facing-away-from-the-chest mode, the adjustable length portion 62 of the weight-support strap assembly 60 and the adjustable length portion 66 of the restraint strap assembly 64 are adjusted so that the seat assembly 44 is located midway between the ends of the respective strap assemblies.

It is understood that the left-shoulder-facing mode shown in FIG. 3 can be easily altered into a right-shoulder facing mode. In such a right-shoulder facing mode, the seat assembly 44 is placed in front of the second shoulder strap 16. The second end connector 65 of the weight-support strap assembly 60 is connected to the second top outer fastener 32 of the second shoulder strap 16. The first end connector 63 of the weight-support strap assembly 60 is connected to the second inner fastener 36 of the second inner fastener 36. Moreover, the adjustable length portion 62 of the weight-support strap assembly 60 and the adjustable length portion 66 of the restraint strap assembly 64 are adjusted so that the seat assembly 44 is located in front of the second shoulder strap 16.

As shown in the drawing figures, the end connectors 63 and 65 of the weight-support strap assembly 60 are connected to either the first top outer fastener 20, the first inner fastener 26, the second top outer fastener 32, or the second top outer fastener 32, and the end connectors 68 and 70 of the restraint strap assembly 64 are connected to the first bottom outer fastener 22 and the second bottom outer fastener 34. It is understood, that alternatively, the end connectors 63 and 65 of the weight-support strap assembly 60 can be connected to the first bottom outer fastener 22 and the second bottom outer fastener 34. Also, alternatively, the end connectors 68 and 70 of the restraint strap assembly 64 can be connected to either the first top outer fastener 20, the first inner fastener 26, the second top outer fastener 32, or the second top inner fastener 36.

The adjustable length portion 62 of the weight-support strap assembly 60 and the adjustable length portion 66 of the restraint strap assembly 64 can be secured by buckles 73 and 75, respectively.

The first top outer fastener 20, the first bottom outer fastener 22, the first inner fastener 26, the second top outer fastener 32, the second bottom outer fastener 34, and the second inner fastener 36 can be made from rings as disclosed in the drawings.

The first end connector 63 and the second end connector 65 of the weight-support strap assembly 60 and the first end connector 68 and the second end connector 70 of the restraint strap assembly 64 can be spring loaded connectors as disclosed in the drawings.

As shown in the drawing figures, the first shoulder strap 14, the second shoulder strap 16, and the circumferential binder 18 can be made as a unified, integrated, vest-like structure. More specifically, the first shoulder strap 14, the second shoulder strap 16, and the circumferential binder 18 can be made as a vest made from a cloth garment.

The components of the baby carrier apparatus of the invention can be made from inexpensive and durable metal, plastic, cloth, and rubber materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved baby carrier apparatus that is low in cost, relatively simple in design and operation, and which may advantageously be used to carry a baby in a hands-free manner with the baby in front of the adult. With the invention, a baby carrier apparatus provides hands-free carrying of a baby with the front of the baby and the front of the adult facing each other. With the invention, a baby carrier apparatus provides hands-free carrying of a baby with the front of the baby and the front of the adult facing each other in the vicinity of an adult's shoulder. With the invention, a baby carrier apparatus is provided which permits an adult to easily shift most of the baby's weight from one shoulder to another shoulder when the first shoulder becomes tired. With the invention, a baby carrier apparatus is provided which is easily adjusted to vary the position and orientation of the baby to include the baby's being directly in front of the adult and with the baby facing forward with the baby's back facing the adult.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A baby carrier apparatus, comprising:

a shoulder harness assembly which includes a first shoulder strap having a front portion with outer and inner edge portions and a back portion, a second shoulder strap having a front portion with outer and inner edge portions and a back portion, and a circumferential binder to which said front portion and said back portion of said first shoulder strap and said front portion and said back portion of said second shoulder strap are attached, a first top outer fastener attached to an upper segment of said first shoulder strap outer edge portion and a first bottom outer fastener attached to a lower segment of said first shoulder strap outer edge portion, a first top inner fastener attached to an upper segment of said first shoulder strap inner edge portion, a second top outer fastener attached to an upper segment of said second shoulder strap outer edge portion and a second bottom outer fastener attached to a lower segment of said second shoulder strap outer edge portion, a second top inner fastener attached to an upper segment of said second shoulder strap inner edge portion, a seat assembly having a baby-bottom-receiving portion and a baby-back-receiving portion, wherein said baby-bottom-receiving portion includes front restraint-strap receiving loops, and wherein said baby-back-receiving portion includes back restraint-strap receiving loops, a weight-support strap assembly attached to a bottom portion of said baby-bottom-receiving portion of said seat assembly, wherein said weight-support strap assembly includes an adjustable length portion, wherein said weight-support strap assembly includes a first end connector for selectively connecting to one of said first top outer fastener or said second top inner fastener, and wherein said weight-support strap assembly includes a second end connector for selectively connecting to one of said second top outer fastener or said first top inner fastener, and a restraint strap assembly selectively threaded through either said front restraint-strap receiving loops or said back restraint-strap receiving loops, wherein said restraint strap assembly includes a first end connector for selectively connecting to one of said first top outer fastener or first bottom outer fastener attached to said first shoulder strap, and wherein said restraint strap assembly includes a second end connector for selectively connecting to one of said second top outer fastener or second bottom outer fastener attached to said second shoulder strap.

2. The apparatus of claim 1 wherein said seat assembly includes safety strap assemblies selectively connected between said baby-bottom-receiving portion and said baby-back-receiving portion of said seat assembly.

3. The apparatus of claim 1, further including:

a buckle and strap assembly connected between a first front portion of said circumferential binder and a second front portion of said circumferential binder.

4. The apparatus of claim 1 wherein said restraint strap assembly includes an adjustable length portion.

5. The apparatus of claim 1 wherein:

said first shoulder strap is in a form of a first shoulder panel, said first top outer fastener and said first bottom outer fastener are attached to an outer edge of said first shoulder panel, and said first inner fastener is attached to an inner edge of said first shoulder panel.

6. The apparatus of claim 1 wherein:

said second shoulder strap is in a form of a second shoulder panel, said second top outer fastener and said second bottom outer fastener are attached to an outer edge of said second shoulder panel, and said second inner fastener is attached to an inner edge of said second shoulder panel.

* * * * *